US005572301A

United States Patent [19]

Shiratori

[11] Patent Number: 5,572,301

[45] Date of Patent: Nov. 5, 1996

[54] DEVELOPING DEVICE TO WHICH DRIVE TRANSMISSION FROM A CARTRIDGE IS CUT OFF

[75] Inventor: Tatsuya Shiratori, Yokohama, Japan

[73] Assignee: Canon Kabushiki Kaisha, Tokyo, Japan

[21] Appl. No.: 515,326

[22] Filed: Aug. 15, 1995

[30] Foreign Application Priority Data

Aug. 22, 1994 [JP] Japan ..... 6-196846

[51] Int. Cl.[6] ..... G03G 15/06

[52] U.S. Cl. ..... 399/234; 399/263

[58] Field of Search ..... 355/260, 245, 355/246, 200, 210, 259; 222/DIG. 1; 403/325

[56] References Cited

U.S. PATENT DOCUMENTS 4,754,301 6/1988 Kasamura et al. ..... 355/245

5,053,816 10/1991 Takahashi ..... 355/245 X 5,168,319 12/1992 Kimura et al. ..... 355/245 X 5,294,968 3/1994 Ueda et al. ..... 222/DIG. 1 X 5,489,976 2/1996 Ichikawa ..... 355/260

*Primary Examiner*—Arthur T. Grimley

*Assistant Examiner*—Shuk Yin Lee

*Attorney, Agent, or Firm*—Fitzpatrick, Cella, Harper & Scinto

[57] ABSTRACT

A developing device is provided with a supporting device for removably and rotatably supporting a toner cartridge containing a toner therein and having a toner supplying opening portion and toner discharge device for discharging the toner in the toner cartridge through the opening portion, driving device for driving the toner discharge device, and cut-off device for cutting off the drive transmission of the driving device during the rotation of the toner cartridge.

12 Claims, 4 Drawing Sheets

DEVELOPING DEVICE TO WHICH DRIVE TRANSMISSION FROM A CARTRIDGE IS CUT OFF

BACKGROUND OF THE INVENTION

1. Field of the Invention

This invention relates to a developing device which is used in an image forming apparatus such as a copying apparatus or a printer and in which a toner cartridge is removably mountable.

2. Related Background Art

Many developing devices using cylindrical toner cartridges have become commercially available as developing devices for use in image forming apparatuses, particularly electrophotographic copying apparatuses. These cylindrical toner cartridges are easy to insert into the bodies of developing devices and are easy to rotate in the developing devices after the insertion thereof into the latter.

Now, a high sealing property is required of a toner cartridge containing a developer (hereinafter referred to as the toner) therein so as to prevent the toner from leaking out when the toner is supplied to a developing device. The reason is that the leakage of the toner out of the developing device would stain a user's hands or clothes.

It has therefore been practiced to mount the toner cartridge in the device body with the opening portion thereof which is sealed by a sealing material remaining turned upward, and peel off the sealing material, and thereafter rotate the toner cartridge so that the opening portion may face laterally, and when dismounting the toner cartridge, rotate the toner cartridge so that the opening portion may face upward so that any toner remaining in the toner cartridge may not spill, and thereafter pull out the toner cartridge.

An agitating bar for discharging the toner from an opening portion is provided in the toner cartridge, but when the driving construction of the agitating bar and the developing device has been simplified and the agitating bar and a developing sleeve have been connected together by gears and a driving load has been made small, the following problem has arisen.

When the toner cartridge is inserted into the device and is rotated, the agitating bar in the cartridge is also rotated therewith.

The rotation of this agitating bar causes the rotation of a driving gear train, which in turn causes the reverse rotation of the agitating bar and developing sleeve in the developing device and thus, the unsatisfactory conveyance of the toner and the unsatisfactory coating of the toner on the developing sleeve occur and unsatisfactory images are created.

SUMMARY OF THE INVENTION

It is an object of the present invention to provide a developing device of which the interior is prevented from being adversely affected when a toner cartridge is mounted or dismounted.

It is another object of the present invention to provide a developing device in which a toner carrying member is not rotated when a toner cartridge is rotated.

It is still another object of the present invention to provide a developing device having supporting means for removably and rotatably supporting a toner cartridge containing a toner therein and having a toner supply opening portion and toner discharge means for discharging the toner in the toner cartridge through said opening portion, driving means for driving said discharge means, and cut-off means for cutting off the drive transmission of said driving means during the rotation of said toner cartridge.

Other objects of the present invention will become apparent from the following detailed description.

DESCRIPTION OF THE PREFERRED EMBODIMENTS

Figure 3:
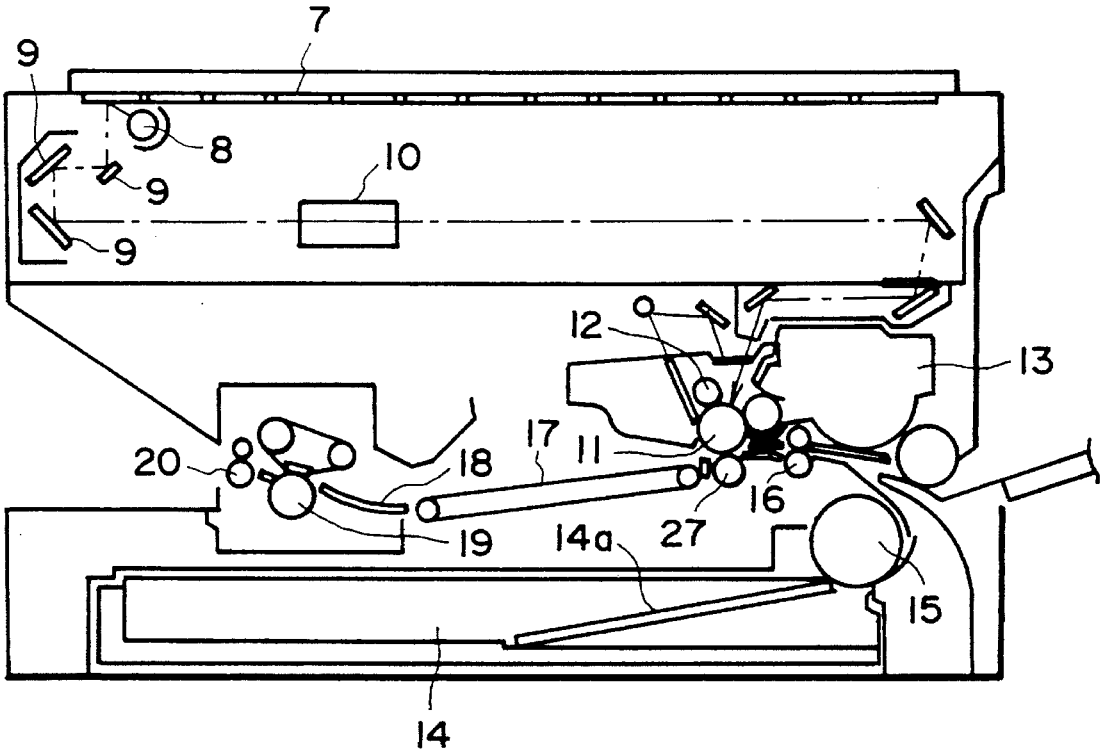
FIG. 3 is a longitudinal cross-sectional view of an electrophotographic copying apparatus.

FIG. 3 is a longitudinal cross-sectional view of an electrophotographic copying apparatus which is an image forming apparatus using a developing device according to an embodiment of the present invention.

In the electrophotographic copying apparatus shown in FIG. 3, an original placed on original supporting glass 7 is illuminated by an illuminating lamp 8 and the reflected light therefrom is applied via a mirrors 9 and a lens 10 to the surface of a photosensitive drum 11 which is an image bearing member. The photosensitive drum 11 is charged to a predetermined potential by a primary charging roller 12, and by image light being applied to the surface thereof, an electrostatic latent image is formed thereon. This electrostatic latent image is developed by a developing device 13 and is visualized as a toner image.

On the other hand, transfer sheets stacked in a sheet supply cassette 14 are pressed against a sheet feeding roller 15 one-by-one by an intermediate plate 14*a* and are conveyed to a pair of register rollers 16 by the sheet feeding roller 15 being rotated. The register rollers 16 start to rotate while taking a timing in order to adjust the position of the transfer sheet to the position of the electrostatic latent image on the photosensitive drum 11, and the toner image on the photosensitive drum 11 is transferred onto the transfer sheet being conveyed at a suitable timing, by a transfer roller 27. The transfer sheet onto which the toner image has been transferred is further conveyed by a conveying portion 17 and is directed along a fixation entrance guide 18 to a fixating device 19, by which the toner image on the transfer sheet is fixated, whereafter the transfer sheet is discharged out of the apparatus by sheet discharge rollers 20.

The developing device according to the embodiment of the present invention will now be described in detail with reference to FIGS. 4 to 7C.

Figure 4:
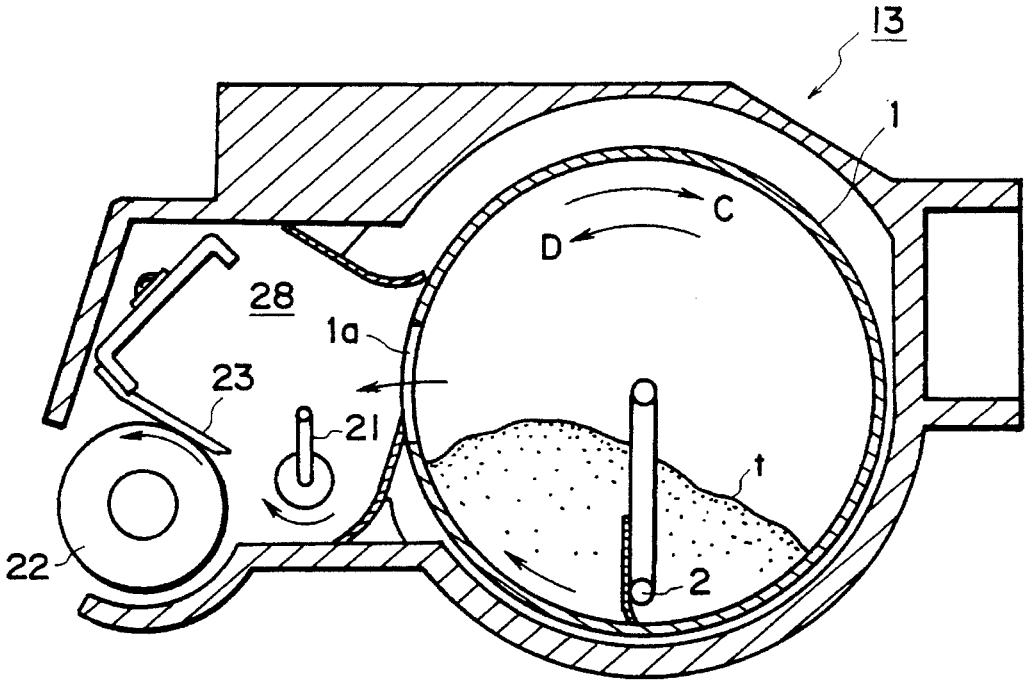
FIG. 4 is a longitudinal cross-sectional view of the developing device.

FIG. 4 is a cross-sectional view of the developing device 13 and a toner cartridge 1 inserted in the developing device 13. As shown, the toner cartridge 1 is formed in the shape of a cylinder, and a toner t and an agitating bar 2 for conveying the toner t through an opening portion 1*a* into a developing chamber 28 are contained in the toner cartridge 1.

Thus, by the agitating bar 2 being rotated in the direction of the arrow shown in FIG. 4, the toner t in the toner cartridge 1 is conveyed through the opening portion 1*a* into the developing chamber 28, and is further conveyed by a second agitating bar 21 provided in the developing chamber 28 to an area in which a developing sleeve 22 and a blade 23 are in contact with each other, whereby a thin-layer coating of the toner is applied onto the developing sleeve 22.

When the toner cartridge 1 is to be interchanged because the toner t therein has been used up, the toner cartridge 1 is rotated in the direction of arrow C in FIG. 4 and with the opening portion 1*a* turned substantially upward, the toner cartridge is pulled out toward this side, whereby the toner cartridge 1 can be taken out of the developing device 13.

Figure 6:
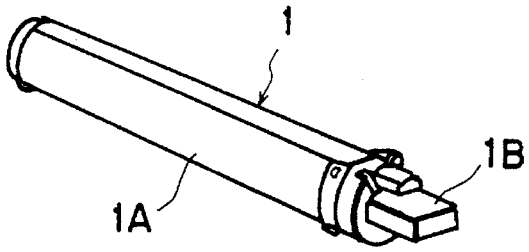
FIG. 6 is a perspective view of a toner cartridge.

Now, as shown in FIG. 6, the toner cartridge 1 is comprised of a cylinder portion 1A and a grip portion 1B, and in the toner cartridge when unused, a seal material 29 (see FIG. 7B) is adhesively secured to the opening portion 1*a* (see FIG. 4) so that the toner t may not leak out.

Figure 7A:
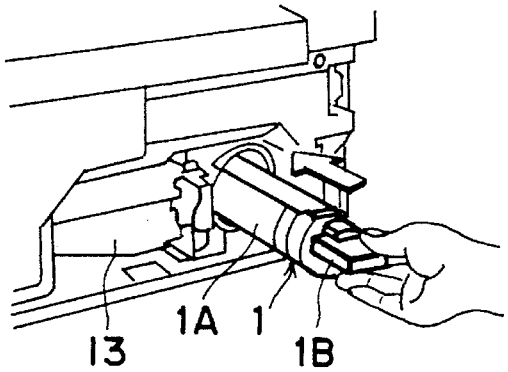
FIGS. 7A, 7B, and 7C are perspective views illustrating a series of toner supply operations by the toner cartridge.
Figure 7B:
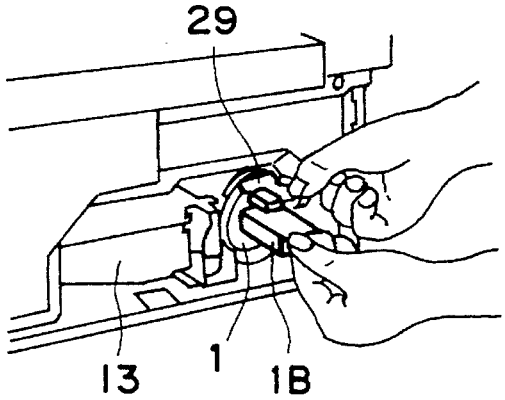
Figure 7C:
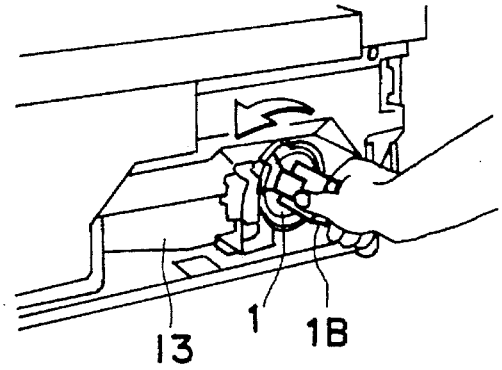

FIGS. 7A to 7C are perspective views illustrating a series of toner supply operations by the toner cartridge 1. In case of toner supply, as shown in FIG. 7A, a user first holds the grip 1B of the toner cartridge 1, and then inserts the toner cartridge 1 into the developing device 13 in the direction of arrow. Next, as shown in FIG. 7B, the user pulls the seal material 29 away from the developing device 1B by his or her other hand while holding down the grip 1B, thereby peeling off the seal material 29. If, thereafter, as shown in FIG. 7C, the toner cartridge 1 is rotated in the direction of the arrow, the opening portion 1*a* will turn toward the developing chamber 28 side as shown in FIG. 4, and the conveyance of the toner t out into the developing chamber 28 will become possible, thus terminating the series of toner supply operations.

The driving of the developing device 13 will now be described with reference to FIG. 5.

Figure 5:
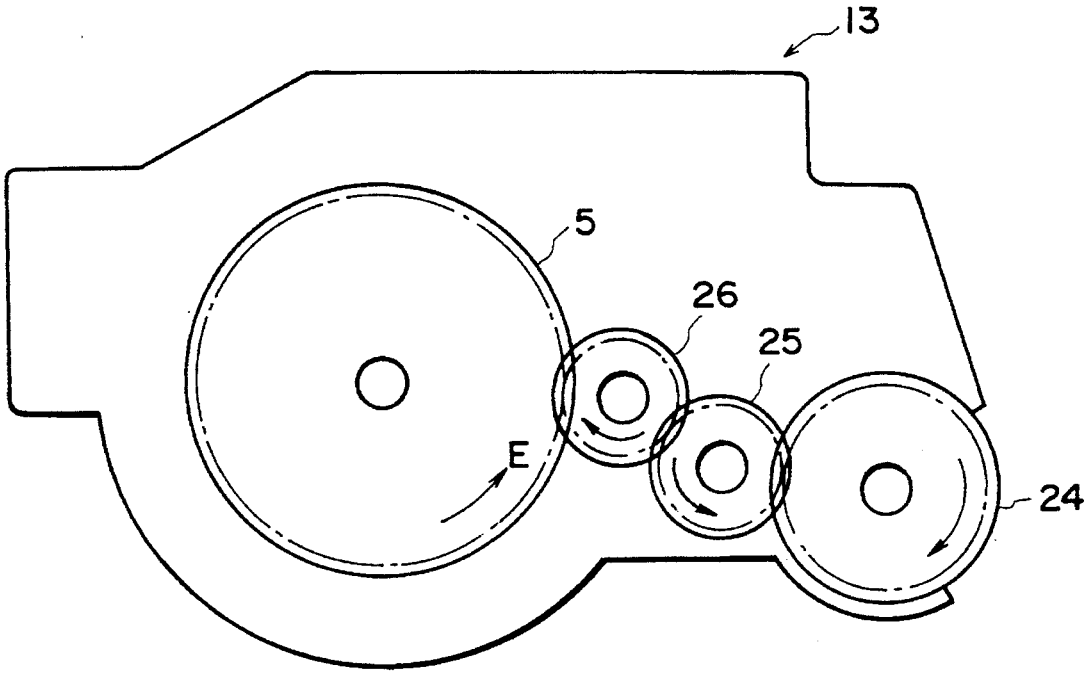
FIG. 5 is a view of the driving portion of the developing device as it is seen from the back side of the body thereof.

FIG. 5 is a view of the driving portion of the developing device 13 as it is seen from the back side thereof. In FIG. 5, the reference numeral 24 designates the input gear of the developing sleeve. The input gear 24 receives a drive force from a drum gear, not shown, disposed coaxially with the photosensitive drum 11 (see FIG. 3) and is rotated in the direction of the arrow. When the input gear 24 is rotated, this rotation is transmitted to a gear 5 through a gear 25 for driving the second agitating bar 21 (see FIG. 4) and an idler gear 26, and the gear 5 is rotatively driven in the direction of arrow E and by the rotation of this gear 5, the agitating bar 2 (see FIG. 4) in the toner cartridge 1 is rotatively driven in the direction of the arrow.

Although not shown, a coupling for receiving a drive force from the body of the developing device 13 is provided on the inner side of the toner cartridge 1 and is engaged with the gear 5.

Figure 1:
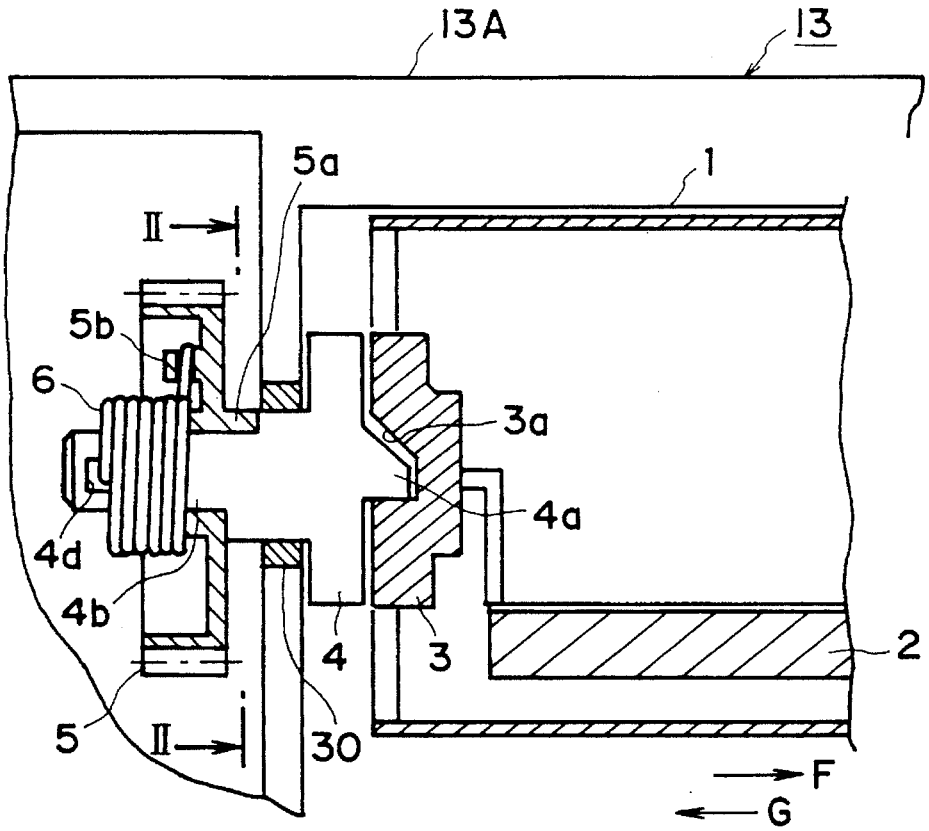
FIG. 1 is a fragmentary cross-sectional view showing the construction of a drive transmitting portion on the inner side of a toner cartridge in a developing device according to the present invention.
Figure 2A:
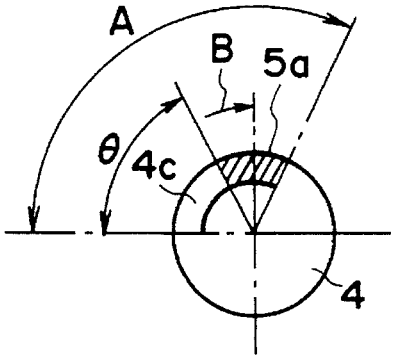
FIGS. 2A and 2B are cross-sectional view taken along the line II—II of FIG. 1.
Figure 2B:
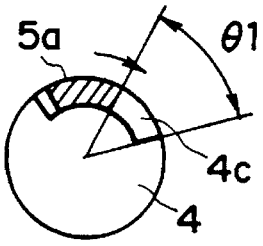

FIG. 1 shows the construction of a drive transmitting portion on the inner side of the toner cartridge, and FIGS. 2A and 2B are cross-sectional views taken along the line II—II of FIG. 1.

A coupling 3 is provided in the inner side end portion of the toner cartridge 1, and one end of the agitating bar 2 is attached to the coupling 3, and the two are rotatable as a unit.

On the other hand, a drive transmitting member 4 is rotatably supported on the developing device body 13A side with a bearing 30 interposed therebetween, and the drive transmitting member 4 is connected to the coupling 3 by a pawl 4*a* formed on one end thereof being engaged with an engagement groove 3*a* formed in that end surface of the coupling 3 which is adjacent to the toner cartridge 1.

Now, the gear 5 (see FIG. 5) is rotatably supported on the other end shaft portion 4*b* of the drive transmitting member 4, and as shown in FIGS. 2A and 2B, an engagement groove 4*c* is partially formed within the range of an angle A in the outer periphery of that portion of the shaft portion 4*b* of the drive transmitting member 4 which is near the bearing 30. A projection 5*a* partly protrudedly provided on one end surface of the gear 5 is engaged with the engagement groove 4*c*.

A shock absorbing torsion coil spring 6 is wound around the boss portion of the gear 5, and one end of this torsion coil spring 6 is restrained in a groove 4*d* formed in the shaft portion 4*b* of the drive transmitting member 4 and the other end of the torsion coil spring 6 is hooked on a hook 5*b* protrudedly provided on the gear 5.

Thus, the gear 5 is biased in the direction of rotation thereof (the direction of rotation of the agitating bar 2; the rotation of the arrow B in FIG. 2A), and this gear is held in a position wherein the projection 5*a* thereof bears against one end of the engagement groove 4*c* in the drive transmitting member 4, as shown in FIG. 2A.

In the above-described construction, when the user pulls out the toner cartridge 1 in the direction of arrow F in FIG. 1 and removes it from the developing device body 13A, and thereafter inserts an unused new toner cartridge 1 into the developing device body 13A in the direction of arrow G in FIG. 1 (see FIG. 7A), the pawl 4*a* of the drive transmitting member on the developing device body 13A side comes into engagement with the engagement groove 3*a* in the coupling provided on the inner side end surface of the toner cartridge 1, whereby the coupling 3 is connected to the drive transmitting member 4.

When subsequently, the user peels off seal material 29 which has so far closed the opening portion 1*a* (see FIG. 4) of the toner cartridge 1 (see FIG. 7B) and rotates the toner cartridge 1 in the direction of arrow D in FIG. 4 so that the opening portion 1a thereof may open to the developing chamber 28 of the developing body 13A (see FIG. 7C), the rotation of the toner cartridge 1 is transmitted to the drive transmitting member 4 through the coupling 3.

Here, the gear 5 keeps itself stationary by the load provided by its meshing engagement with the other gears 26, 25 and 24 (see FIG. 5) and therefore, the drive transmitting member 4 alone is rotated with the toner cartridge 1 by an angle $\theta_1$ (see FIG. 2B) in the direction of arrow B within the range of the angle θ of FIG. 2A. When the drive transmitting member 4 is thus rotated with the gear 5 remaining stationary, the torsion coil spring 6 is deformed and its restitutive force increases, but the restitutive force of this torsion coil spring 6 is smaller than the load acting on the gear 5 and therefore, the gear 5 keeps its stationary state and is not rotated. As described above, even if the toner cartridge 1 is rotated during the mounting of the toner cartridge 1 into the developing device body 13A, the gear 5 keeps its stationary state and therefore does not reversely rotate the agitating bar 21 and developing sleeve 22 (see FIG. 4) in the developing chamber 28, and can prevent the unsatisfactory conveyance of the toner t and the occurrence of bad coating of the developing sleeve with the toner, thus stably obtaining images of high quality.

Thus, when a main motor, not shown, provided in the copying apparatus body is driven for the copying operation after the toner cartridge 1 has been mounted into the developing device body 13A as described above, the rotation of this main motor is transmitted to the gear 5 via the gears 24 to 26 shown in FIG. 5, and the gear 5 is rotatively driven in the direction of arrow E in FIG. 5. Thereupon, the projection 5*a* of the gear 5 is rotated in the direction of the arrow from the state shown in FIGS. 2A and 2B and at a point of time whereat it has been rotated by an angle $\theta_1$, it comes into engagement with one end of the engagement groove 4*c* in the drive transmitting member 4 and therefore, thereafter the gear 5 and the drive transmitting member 4 are rotated as a unit and the increment of the restitutive force stored in the torsion coil spring 6 is made to disappear.

The rotation of the gear 5 and drive transmitting member 4 is transmitted to the agitating bar 2 through the coupling 3, and the agitating bar 2 is rotatively driven in the toner cartridge 1 in the direction of arrow C in FIG. 4 (a clockwise direction), whereby the toner t contained in the toner cartridge 1 is conveyed out through the opening portion 1*a* into the developing chamber 28 (see FIG. 4) for use in development.

While an embodiment of the present invention has been described above, the present invention is not restricted to this embodiment, but permits all modifications within the technical idea of the invention.

What is claimed is:

1. A developing device comprising:

supporting means for removably and rotatably supporting a toner cartridge containing a toner therein and having a toner supply opening portion and toner discharge means for discharging the toner in the toner cartridge through said opening portion;

driving means for driving said toner discharge means; and cut-off means for cutting off drive transmission of said driving means during rotation of said toner cartridge.

2. A developing device according to claim 1, wherein said toner cartridge is rotatable between a removably mounted position in which it is removably mounted and a supply position for supplying the toner, and said cut-off means cuts off the drive transmission during the rotation of said toner cartridge between the removably mounted position and the supply position.

3. A developing device according to claim 1, wherein said cut-off means cuts off a drive power transmitted to said driving means in a direction of rotation opposite to the direction of rotation during the driving.

4. A developing device according to claim 3, wherein said toner cartridge is rotatable between a removably mounted position in which it is removably mounted in the device and a supply position for supplying the toner, and a drive force in the opposite direction is created during the rotation of said toner cartridge from the removably mounted position to the supply position.

5. A developing device according to claim 1, further provided with a developing chamber having a toner carrying member for carrying the toner in said opening portion and containing the toner therein, and wherein said toner discharge means supplies the toner to said developing chamber.

6. A developing device according to claim 5, wherein said toner discharge means and said toner carrying member are connected together in driving.

7. A developing device according to claim 6, wherein said toner discharge means and said toner carrying member are gear-connected together.

8. A developing device according to claim 6, wherein said cut-off means cuts off a drive force which rotates said toner carrying member in a direction opposite to that during development.

9. A developing device according to claim 5, further provided with conveying means for conveying the toner supplied into said developing chamber toward said toner carrying member, and wherein said toner discharge means and said conveying means are connected together in driving.

10. A developing device according to claim 9, wherein said toner discharge means and said conveying means are gear-connected together.

11. A developing device according to claim 10, wherein said cut-off means cuts off a drive force by which said conveying means drives in a direction to convey the toner toward said toner cartridge.

12. A developing device according to claim 1, wherein said cut-off means has a coil spring for transmitting a drive force from said driving means to said toner discharge means and absorbing as slack a drive force created by the rotation of said toner cartridge.

* * * * *